US005709971A

United States Patent [19]

Bowman et al.

[11] Patent Number: 5,709,971

[45] Date of Patent: Jan. 20, 1998

[54] DYE IMBIBITION PRINTING BLANKS WITH ANTISTATIC LAYER

[75] Inventors: Wayne Arthur Bowman, Walworth; Charles Peter Hagmaier, Rochester; Frank Dean Manioci, Henrietta, all of N.Y.

[73] Assignee: Eastman Kodak Company, Rochester, N.Y.

[21] Appl. No.: 614,423

[22] Filed: Mar. 12, 1996

[51] Int. Cl.[6] ..... G03C 1/85; G03C 8/52; B41N 1/00

[52] U.S. Cl. ..... 430/14; 430/199; 430/212; 430/215; 430/527; 430/529; 430/530; 430/941; 430/213; 430/140; 101/464

[58] Field of Search ..... 430/199, 213, 430/212, 215, 941, 527, 530, 529, 140, 14; 101/464

[56] References Cited

U.S. PATENT DOCUMENTS

| | | | |
|---|---|---|---|
| 2,837,430 | 6/1958 | Goldberg et al. | 430/292 |
| 3,625,694 | 12/1971 | Cohen et al. | 430/213 |
| 3,898,088 | 8/1975 | Cohen et al. | 430/213 |
| 3,958,995 | 5/1976 | Campbell et al. | 430/213 |
| 4,266,044 | 5/1981 | Timmerman et al. | 525/336 |
| 5,135,835 | 8/1992 | Aono et al. | 430/203 |
| 5,437,956 | 8/1995 | Nakamura et al. | 430/213 |

FOREIGN PATENT DOCUMENTS

461416 A2 12/1991 European Pat. Off. .

*Primary Examiner*—Richard L. Schilling
*Attorney, Agent, or Firm*—Andrew J. Anderson

[57] ABSTRACT

Dye imbibition printing blanks are disclosed comprising a support bearing on one side thereof a dye-receiving layer comprising a cationic mordant, and further comprising an antistatic layer substantially free of cationic polymers. The antistatic layer is preferably provided on the opposite side of the support relative to the dye-receiving layer. Such antistatic layer provides improved antistatic properties which enable high manufacturing and processing speeds without adversely affecting printed image qualities.

20 Claims, No Drawings

DYE IMBIBITION PRINTING BLANKS WITH ANTISTATIC LAYER

CROSS REFERENCE TO RELATED APPLICATION

Reference is made to and priority claimed from U.S. Provisional application Ser. No. 60/000,367, filed 20 Jun. 1995, entitled DYE IMBIBITION PRINTING BLANKS WITH ANTISTATIC LAYER.

FIELD OF THE INVENTION

This invention relates to a photographic imbibition dye transfer process and imbibition printing materials. It relates particularly to improved dye imbibition printing blanks with improved antistatic properties.

BACKGROUND OF THE INVENTION

The imbibition printing dye transfer process is well known. According to common procedures, a tanned colloid relief image is formed by imagewise exposure of a suitable light sensitive layer on a support, differentially hardening the colloid layer in accordance with the imagewise exposure, and removing the colloid from the support in inverse proportion to the amount of imagewise light exposure. The differential colloid hardening and removal is conventionally performed with a pyrogallol hardening developer as described, e.g., in U.S. Pat. No. 2,837,430, the disclosure of which is hereby incorporated by reference. For full color prints, three separate relief images corresponding to the blue, green, and red color records of the image being reproduced may be formed in separate blue, green, and red light sensitive matrix films by three separate exposures though a color negative film. The resultant colloid relief images are then dyed with yellow, magenta and cyan dyes, and the dye images transferred to an imbibition printing blank receiver film. In this manner imbibition printed colored dye images may be obtained which faithfully reproduce a colored subject. Imbibition printing blanks comprise a dye receiving layer on a support. Where the resulting image is intended to be viewed by light projection, such as in a motion picture film, a transparent film support is generally used.

The photographic industry has long recognized the need to provide photographic film and paper with antistatic protection to prevent the accumulation of static charges during manufacture and use. Such protection is advantageous in photographic elements as static charges can cause irregular fog patterns in photographic silver halide imaging emulsions. To prevent the problems arising from an accumulation of static charges, it is conventional practice to provide an antistatic layer (i.e., a conductive layer) in a photographic element.

A wide variety of antistatic layers are known for use in photographic elements. Such layers, however, have not previously been used with dye imbibibition printing blanks. As the visual dye image is transfered to an imbibition printing element blank rather than being formed directly in a silver halide emulsion imaging layer of the element, and as the back side of an imbibition printing element support bearing a dye receiving layer will be in contact with such dye receiving layer when the element is rolled up, such printing elements have different requirements as to antistatic protection needs. While image fog problems due to static charge buildup are generally not a problem with imbibition printing elements, such charges may attract dirt and dust to the printing element surface under high manufacturing and processing speeds which may result in the formation of "pinholes" in the processed imbibition printing blanks as well as a variety of handling and conveyance problems.

PROBLEM TO BE SOLVED

It would be desireable to provide imbibition printing element blanks having sufficient antistatic properties which enable high manufacturing and processing speeds without adversely affecting printed image qualities.

SUMMARY OF THE INVENTION

This invention provides an improved dye imbibition printing blank comprising a support bearing on one side thereof a dye-receiving layer comprising a cationic mordant, and further comprising an antistat layer substantially free of cationic polymers. In a preferred embodiment of the invention, the antistatic layer is provided on the opposite side of the support relative to the dye-receiving layer. Such antistatic layer provides improved antistatic properties which enable high manufacturing and processing speeds without adversely affecting printed image qualities.

DESCRIPTION OF THE PREFERRED EMBODIMENTS

Dye imbibition printing blanks within the scope of this invention comprise a support bearing on one side thereof a dye receiving layer containing a cationic mordant, and further comprise an antistatic layer. In a preferred embodiment, in addition to the cationic mordant, the dye image receiving layer also comprises a hydrophilic colloid, and a plasticizer polymer.

Any antistatic conductive materials, excluding cationic polymers, such as those previously suggested for use with photographic elements may be used in the printing element antistatic layer in accordance with the invention. Such materials include, e.g., anionic polymers, electronic conducting non-ionic polymers, and electrically-conductive metal-containing particles such as metal halides or metal oxides in polymer binders. While antistatic compositions comprising a cationic polymer are also applicable for use with conventional photographic elements, such as the highly crosslinked vinylbenzyl quaternary ammonium polymer disclosed in U.S. Pat. No. 4,070,189, such antistatic materials are excluded from the scope of the instant invention. Dyes intended for printing on the cationic mordant containing printing blanks of the invention are anionic and will transfer from the front dye-receiving side of the film to the antistat backing when such sides come into contact (such as in a rolled film) if the backing contains a catonic polymeric material such as quaternary ammonium polymer, resulting in dye stain. For the purposes of this invention, "substantially free of cationic polymers" is intended to apply to the absence of cationic polymers above trace or impurity levels.

Examples of suitable antistatic materials and layers include the following. U.S. Pat. No. 3,033,679 discloses an antistatic layer comprised of an alkali metal salt of a copolymer of styrene and styrylundecanoic acid. Films having a metal halide, such a sodium chloride or potassium chloride, as the conducting material in a hardened polyvinyl alcohol binder are described in U.S. Pat. No. 3,437,484. In U.S. Pat. No. 3,525,621, the antistatic layer is comprised of colloidal silica and an organic antistatic agent such as an alkali metal salt of an alkylaryl polyether sulfonate, an alkali metal salt of an arylsulfonic acid, or an alkali metal salt of a polymeric carboxylic acid. An antistatic layer comprised of an anionic film forming polyelectrolyte, colloidal silica, and a polyalkylene oxide is disclosed in U.S. Pat. No. 3,630,740 while U.S. Pat. No. 3,681,070 describes a copolymer of styrene and styrene sulfonic acid as an antistatic agent. U.S. Pat. No. 4,542,095 describes antistatic compositions comprising a binder, a nonionic surface-active polymer having polymerized alkylene oxide monomers, and an alkali metal salt. In U.S. Pat. No. 4,916,011, an antistatic layer comprising a styrene sulfonate-maleic acid copolymer, a latex binder, and an alkyl-substituted trifunctional aziridine crosslinking agent are disclosed. Antistat layers comprising a polythiophene with conjugated polymer backbone in the presence of a polymeric polyanion compound are described in EP 554,588; EP 553,502; EP 564,911; DE 4,138,628. The disclosures of the above referenced patents and patent applications in this paragraph are hereby incorporated by reference.

Any of the wide diversity of electrically-conductive metal-containing particles proposed for use heretofore in imaging elements can be used in the electrically-conductive antistatic layer of this invention. Examples of useful electrically-conductive metal-containing particles include donor-doped metal oxides, metal oxides containing oxygen deficiencies, and conductive nitrates, carbides or borides. Specific examples of particularly useful particles include conductive $TiO_2$, $SnO_2$, $Al_2O_3$, $ZrO_2$, $In_2O_3$, ZnO, $TiB_2$, $ZrB_2$, $NbB_3$, $CrB_2$, MoB, Wb, $LaB_6$, ZrN, TiN, TiC, WC, HfN, and ZrC.

Metal oxides, and particularly vanadium pentoxide as described, for example, in Guestaux, U.S. Pat. No. 4,203,769, the disclosure of which is hereby incorporated by reference, are preferred for use in the dye imbibition printing elements of the invention. Antistatic layers containing vanadium pentoxide provide excellent protection against static and are highly advantageous in that they have excellent transparency and their performance is not significantly affected by changes in humidity. The use of metal oxide materials is further advantageous, as their antistatic properties allow the use of a protective overcoat layer such as a layer of cellulosic material to provide abrasion protection and/or enhance frictional characteristics while still providing acceptable antistatic performance.

Conductive fine particles of crystalline metal oxides dispersed with a polymeric binder have been used to prepare optically transparent, humidity insensitive, antistatic layers for various imaging applications. Many different metal oxides, such as AnO, $TiO_2$, $ZrO_2$, $Al_2O_3$, $SiO_2$, MgO, BaO, $MoO_3$, and $V_2O_5$, are disclosed as useful as antistatic agents in photographic elements or as conductive agents in electrostatographic elements in such patents as U.S. Pat. Nos. 4,275,103; 4,394,441; 4,416,963; 4,418,141; 4,431,764; 4,495,276; 4,571,361; 4,999,276; and 5,122,445, the disclosures of which are hereby incorporated by reference. Preferred metal oxides are antimony doped tin oxide, aluminum doped zinc oxide, and niobium doped titanium oxide, as these oxides have been found to provide acceptable performance characteristics in demanding environments.

Particular preferred metal oxides for use in this invention are antimony-doped tin oxide and vanadium pentoxide having good resistance to static discharge and no dye stain resulting from transfer of dye from front side to the back of the film. For high dye imbibition printing blank manufacturing and processing speeds (e.g., transport speeds above about 60 m/s), a surface resistivity of less than $10^9$ ohms per square is desired for the printing blanks to prevent static discharges during unwinding of the film and the buildup of static dirt during handling of the film.

Preferred binders which may be included in the antistatic layer of the printing blanks of the invention include vinylidene chloride-containing latexes and polyesterionomer dispersions, which can improve the integrety of the layer and the adhesion of the layer to the support. Polyesterionomer refers to polyesters that contain at least one ionic moiety. Such ionic moieties function to make the polymer water dispersable. These polymers are prepared by reacting one or more dicarboxylic acids or their functional equivalents such as anhydrides, diesters, or diacid halides with one or more diols in melt-phase polycondensation reactions well known in the art as shown in U.S. Pat. Nos. 3,018,272, 3,929,489, 4,307,174 and 4,419,437. Examples of this class of polymers include, for example, Eastman AQ polyesterionomers manufactured by Eastman Chemical Company.

To provide protection of the antistatic layer, a protective overcoat may be applied thereon. The protective layer can chemically isolate the antistatic layer and also serve to provide scratch and abrasion resistance. The protective overcoat layers may be, e.g., cellulose esters, cellulose nitrate, polyesters, acrylic and methacrylic copolymers and homopolymers, polycarbonates, polyvinyl formal polymethyl methacrylate, polysilicic acid, polyvinyl alcohol, and polyurethanes. Such layers may be aqueous coated or organic solvent coated as appropriate.

The chemical resistance of the antistatic layer or an overcoat can be improved by incorporating a polymer crosslinking agent into the antistatic layer or those overcoats that have functionally cross-linkable groups. Cross-linking agents such as aziridines, carbodiimide, epoxys, and the like are suitable for this purpose.

A suitable lubricant may also be included in the antistatic layer or protective overcoat in order to provide desired friction performance to assure good transport characteristics during manufacturing and handling of the elements of the invention. Many lubricating agents can be used including higher alcohol esters of fatty acids, higher fatty acid calcium salts, metal stearates, silicone compounds, paraffins and the like. Aqueous dispersed lubricants are preferred as they may be directly incorporated into an aqueous antistatis or overcoat layer, thus avoiding the need for a separately applied lubricant layer. The aqueous dispersed lubricants of carnauba wax and stearates are preferred for their effectiveness in controlling friction at low lubricant levels and their excellent compatibility with aqueous overcoat polymer solutions.

Matting agents may also be included in the antistatic layer or overcoat thereon in order to improve transport properties of the elements of the invention on manufacturing, printing, processing, and projecting equipment. Such matting agents can also help prevent sticking between the front and back sides of the elements in a tightly wound roll. Matting agents may be silica, calcium carbonate, other mineral oxides, glass speres, ground polymers and high melting point waxes, and polymeric matte beads.

The antistatic layer may also contain a coating aid to improve coatability, including anionic or nonionic coating aids such as para-isononylphenoxyglycidol ethers, octylphenoxy polyethoxy ethanol, sodium salt of alkylaryl polyether sulfonate, and dioctyl esters of sodium sulfossuccinic acid, which coating aids are typically used at from 0.01 to 0.30 weight percent based on the total coating solution weight.

Cationic mordants in accordance with the invention are preferably quaternary ammonium and phosphoniummordants of the type described in U.S. Pat. Nos. 3,898,088 and 3,958,995, the disclosures of which are hereby incorporated by reference. The cross-linked mordants of U.S. Pat. No. 3,958,995 are particularly preferred. Such mordants are generally of the formula:

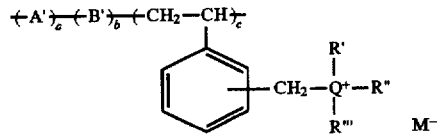

wherein A' represents units of an addition polymerizable monomer containing at least two ethylenically unsaturated groups; B' represents units of a copolymerizable α,β-ethylenically unsaturated monomer; Q is N or P; R', R", and R'" are independently carbocyclic or alkyl groups; $M^-$ is an anion; a is from about 0.25 to 5 mole percent, preferably from about 1 to 10 mole percent; b is from about 0 to 90 mole percent, preferably from about 0 to 60 mole percent; and c is from about 10 to 99 mole percent, preferably from about 40 to 99 mole percent, for effective dye mordanting.

It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents. Typical examples of photographic substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms.

The hydrophilic colloid may be any of those generally employed in the photographic field, including, for example, gelatin, colloidal albumin, polysaccharides, cellulose derivatives, water-soluble polymer or copolymer including, but not limited to polyvinyl compounds, including polyvinyl alcohol and derivatives thereof, partially hydrolyzed poly (vinylacetate-co-vinylalcohol), hydroxyethyl cellulose, poly (acrylic acid), poly(1-vinylpyrrolidone), poly(sodium styrene sulfonate), poly(2-acrylamido-2-methane sulfonic acid), polyacrylamides. Copolymers of these polymers with hydrophobic monomers may also be used. Gelatin is a preferred hydrophilic colloid. This may be gelatin per se or a modified gelatin such as acetylated gelatin, phthalated gelatin, oxidized gelatin, etc. Gelatin may be base-processed, such as lime-processed gelatin, or may be acid-processed, such as acid processed ossein gelatin.

In a preferred embodiment of the invention, the dye-receiving layer of the elements of the invention are hardened with a cross-linking agent. Various types of hardeners are useful in conjunction with elements of the invention. In particular, bis(vinylsulfonyl)methane, bis(vinylsulfonyl) methyl ether, 1,2-bis(vinylsulfonyl-acetamido)ethane, 2,4-dichloro-6-hydroxy-s-triazine, triacryloyltriazine, and pyridinium, 1-(4-morpholinylcarbonyl)-4-(2-sulfoethyl)-, inner salt are particularly useful. Also useful are so-called fast acting hardeners as disclosed in U.S. Pat. Nos. 4,418,142; 4,618,573; 4,673,632; 4,863,841; 4,877,724; 5,009,990; 5,236,822.

In a preferred embodiment, the dye receiving layer of the imbibition printing blanks of the invention include a plasticizer polymer latex as disclosed in co-pending, concurrently filed, commonly assigned U.S. Ser. No. 60/000,355 filed Jun. 20, 1995, now U.S. Ser. No. 08/614,413 filed Mar. 12, 1996. (Kodak Docket No. 71550AJA), the disclosure of which is incorporated herein by reference. Such latex polymer are preferably water insoluble vinyl co-polymers derived from any copolymerizable monomers, such as α,β-ethylenically unsaturated monomer (including two, three, or more repeating units) such as ethylene, propylene, 1-butene, isobutene, 2-methylpentene, 2-methylbutene, 1,1,4,4-tetramethylbutadiene, styrene, α-methylstyrene; monoethylenically unsaturated esters of aliphatic acids such as vinyl acetate, isopropenyl acetate, allyl acetate, etc.; esters of ethyleneically unsaturated mono- or dicarboxylic acids such as methyl methacrylate, ethyl acrylate, diethyl methylenemalonate, etc.; monoethylenically unsaturated compounds such as acrylonitrile, allyl cyanide, and dienes such as butadiene and isoprene. The particular monomer units and their proportions may be selected to achieve a desired glass transition temperature for the resulting polymer as is well known in the art.

For effective plasticizing, the plasticizer polymers of the invention have a glass transition temperature of about 30° C. or lower, more preferably about 20° C. or lower. The latex polymers comprise from about 2 to 20 wt %, more preferably 2 to 10 wt %, of units having a quaternary ammonium group. Such units are preferably acrylic or methacrylic esters or amides to which the quaternary ammonium group is appended. A preferred class of ethylenically unsaturated monomers which may be used to form the remaining 80 to 98 wt % portion of the preferred vinyl polymers of this invention includes acrylic or methacrylic esters and vinyl benzenes.

The imbibition printing blanks of the invention may contain further features and layers as are known in the art. Preferred supports comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate).

If desired, the element can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ, ENGLAND.

Photographic silver halide emulsion layers may also be included in the elements of the invention. In a motion picture film blank, such a layer may be included between the support and the dye receiving layer as is known in the art in order to enable recording a sound track for the film in accordance with conventional motion picture sound track recording, exposing, and processing procedures. Alternatively, a sound track may be printed on the blank receiver as part of the imbibition printing process.

In the following discussion of suitable materials for use in the emulsions and elements that can be used in conjunction with this element, reference will be made to *Research Disclosure,* September 1994, Item 36544, available as described above, which will be identified hereafter by the term "*Research Disclosure.*" The contents of the *Research Disclosure,* including the patents and publications referenced therein, are incorporated herein by reference, and the Sections hereafter referred to are Sections of the *Research Disclosure,* Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

plary yellow, magenta and cyan dyes which may be used in the imbibition printing process include Y-1, Y-2, M-1, and C-1 illustrated below. Preferred imbibition printing matrix films and exposing processes are described in co-pending, concurrently filed, commonly assigned U.S. Ser. No. 60/00,356 filed Jun. 20, 1995, now U.S. Ser. No. 08/614,454 filed Mar. 12, 1996. (Kodak Docket No. 72471AJA), the disclosure of which is incorporated herein by reference.

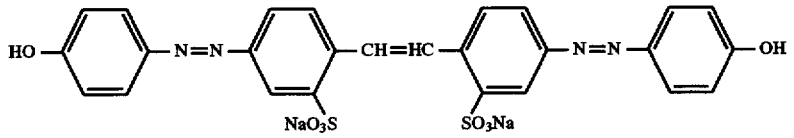

Y-1

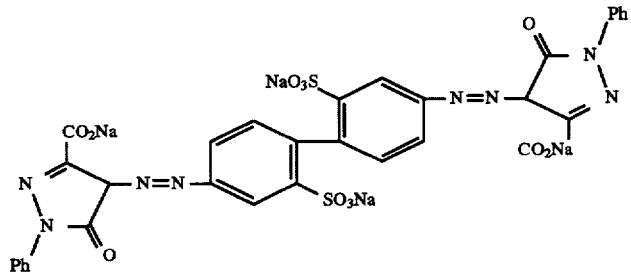

Y-2

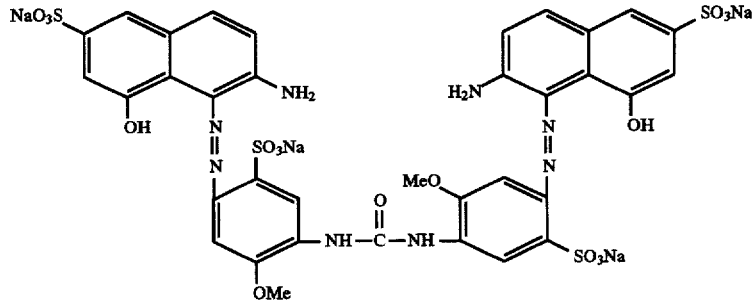

M-1

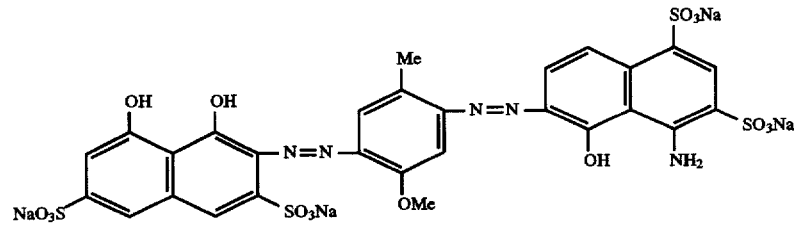

C-1

Matrix films for use with the printing blanks of the invention in imbibition printing dye transfer processes typically comprise a support bearing a light sensitive layer containing a hydrophilic colloid (typically gelatin), visible light absorbing particles (typically carbon), a silver halide light sensitive emulsion, plus various photographic addenda to provide satisfactory stability, as well as coating aids necessary for suitable manufacture. Sensitizing dyes may be used in each of the blue, green and red matrix films to provide blue, green, and red light sensitivity for recording blue, green, and red color records. As described above, after imagewise exposure, the colloid layers of such matrix films are typically differentially hardened and removed with a pyrogallol hardening developer as described in U.S. Pat. No. 2,837,430. After formation of colloid relief images in blue, green and red matrix films, the matrix films are dyed with yellow, magenta and cyan dyes, and the dye images are transferred to the mordant-containing receiver film. Exem-

EXAMPLES

Coated dye imbibition printing blank supports were prepared as follows:

Support 1

A 4.7 mil polyethylene terphthalate film support was coated on the backside with a layer containing a copolymer of styrene sulfonic acid sodium salt and 2-hydroxyethyl methacrylate 70/30 wt (182 mg/m$^2$), a polymer latek of methyl acrylate, vinylidene chloride, and itaconic acid (15/83/02 wt %) (60 mg/m$^2$) and Cymel 300 (melamine-formaldehyde resin crosslinking agent from American Cyanamide Co.) (18 mg/m$^2$) and on the front side with a gel subbing layer containing poly(acrylonitrile-co-vinylidene chloride-co-acrylic acid) (14/80/6 wt %).

Support 2

A 4.7 mil polyethylene terphthalate film support was coated on the backside with a layer containing Nalco 1115

(colloidal silica from Nalco Chemical) (404 mg/m$^2$), a polymer latex of methylacrylate, vinylidene chloride, and itaconic acid 15/83/02 wt (135 mg/m$^2$) and on the front side with a gel subbing layer.

Support 3

A 4.7 mil polyethylene terphthalate film support was coated on the backside with a layer containing antimony-doped tin oxide (370 mg/$^2$) and Witcobond 232 (polyurethane from Witco Corp.) (125 mg/m$^2$) and on the front side with a gel subbing layer.

Support 4

A 4.7 mil polyethylene terphthalate film support was coated on the backside with a layer containing antimony-doped tin oxide (226 mg/m$^2$) and a polymer latex of methyl acrylate, vinylidene chloride, and itaconic acid 15/83/02 wt (75 mg/m$^2$) followed by a layer containing Witcobond 232 (899 mg/m$^2$) and on the front side with a gel subbing layer.

Support 5

A 4.7 mil polyethylene terphthalate film support was coated on the backside with a layer containing Witcobond 232 (899 mg/m$^2$) and on the front side a gel subbing layer followed by a layer containing antimony-doped tin dioxide (296 mg/m$^2$) and gelatin (52 mg/$^2$).

Support 6

A 4.7 mil polyethylene terphthalate film support was coated on the backside with a layer containing Witcobond 232 and a polyaniline imine (1:1 ratio) (108 mg/m$^2$) followed by a layer containing Elvacite 2041 (polymethylmethacrylate from DuPont) (1076 mg/m$^2$) and on the front side a gel subbing layer.

Support 7

A 4.7 mil polyethylene terphthalate film support was coated on the backside with a layer containing a polymer of N-vinylbenzyl-N,N,N-trimethylammonium chloride and ethyleneglycol dimethacrylate 93/7 wt (129 mg/m$^2$) and a polymer of acrylonitrile, vinylidene chloride and N,N-dimethylaminoethyl methacrylate methosulfate 25.1/73.4/1.5 wt (194 mg/m$^2$) and on the front side a gel subbing layer.

Support 8

A 4.7 mil polyethylene terphthalate film support was coated on the backside with a layer containing a polymer of N-vinylbenzyl-N,N,N-trimethylammonium chloride and ethyleneglycol dimethacrylate 93/7 wt (129 mg/m$^2$) and a polymer of acrylonitrile, vinylidene chloride and N,N-dimethylaminoethyl methacrylate methosulfate 25.1/73.4/1.5 wt (194 mg/m$^2$) followed by a layer containing cellulose diacetate (2690 mg/$^2$). The front side was coated with a gel subbing layer.

Support 9

A 4.7 mil polyethylene terphthalate film support was coated on the backside with a layer containing vanadium pentoxide (3.2 mg/m$^2$) and Eastman AQ55D (polyesterionomer from Eastman Chemical Co.) (32 mg/$^2$). The front side of the support was coated with a gel subbing layer.

Support 10

A 4.7 mil polyethylene terphthalate film support was coated on the backside with a layer containing vanadium pentoxide (296 mg/m$^2$) and Eastman AQ29D (polyesterionomer from Eastman Chemical Co.) (3.2 mg/m$^2$) followed by a layer containing Witcobond 232 (899 mg/m$^2$) and the front side was coated with a layer containing a gel sub well known in the art.

Support 11

A 4.7 mil polyethylene terphthalate film support was coated on the backside with a layer containing Elvanol 71-30 (polyvinylalcohol from DuPont) (54 mg/$^2$), Volan (methacrylato chromic chloride from DuPont) (1.9 mg/m$^2$) and potassium nitrate (5.4 mg/$^2$). The front side of the support was coated with a gel subbing layer.

Support 12

A 5 mil polyethylene terphthalate film support was coated on the backside with a layer containing vanadium pentoxide (3.2 mg/m$^2$) and a polymer latex of acrylonitrile, vinylidene chloride and acrylic acid 15/9/76 wt (2.4 mg/m$^2$) followed by a layer containing Elvacite 2041 (1064 mg/$^2$). The front side of the support was coated with a gel subbing layer.

Control Support

A 4.7 mil polyethylene terphthalate film support was coated on the backside with a layer containing Witcobond 232 (899 mg/m$^2$) and on the front side with a gel subbing layer.

Dye imbibition printing blank Samples 1–12 and a Control Sample were made using corresponding Supports 1–12 and the Control Support as follows. Each support was coated on the front side with a layer containing silver bromoiodide emulsion (1940 mg/m$^2$ Ag), EDTA sodium salt (83.2 mg/$^2$), methylbensothiazolium chloride (10.1 mg/$^2$), gelatin (3500 mg/m$^2$) and bisvinylsulfonylmethyl ether (75.6 mg/m$^2$) followed by a layer containing polymer of copoly(N-vinylbenzyl-N,N,N-trimethylammonium chloride-co-ethyleneglycol dimethacrylate) 93/7 mole (861 mg/$^2$), Olin 10G surfactant (97.3 mg/$^2$), potassium nitrate (39.7 mg/$^2$), gelatin (2800 mg/$^2$), and a polymer methacrylate methosulfate 75/25/5 wt (280 mg/$^2$).

The surface electrical resistivity and the water electrode resistivity for certain of the above coatings were measured. The results are indicated in Table 1 below.

TABLE 1

| Sample | Surface Electrical resistivity (ohm/square, 20% RH) | Water Electrode resistivity (ohm/square, 20% RH) |
|---|---|---|
| 1 | $2 \times 10^{10}$ | |
| 2 | $6 \times 10^{11}$ | |
| 3 | $5 \times 10^{8}$ | |
| 5 | | $1 \times 10^{9}$ |
| 6 | | $1 \times 10^{9}$ |
| 7 | $5 \times 10^{9}$ | |
| 8 | | $4 \times 10^{9}$ |
| 9 | $1 \times 10^{9}$ | |
| 10 | | $1 \times 10^{8}$ |
| 11 | $>3 \times 10^{14}$ | |
| 12 | | $1 \times 10^{7}$ |
| Control | $>3 \times 10^{14}$ | $4 \times 10^{11}$ |

Desired resistivity values for surface electrical resistivity are less than about $10^9$ and for water electrode resistivity are less than about $10^9$, and especially less than about $10^8$ ohm/square. While all antistatic materials will improve resistivity levels to some extent, the metal oxide containing antistatic layers of Samples 3, 5, 9, 10, and 12 demonstrate especially preferable results. It is also noted the antistat in Sample 1 is not photographic development process surviving, and therefore not preferred.

An unwinding electrification test is used to determine if there is a "discharge" or "glow" in the unwinding nip of a roll of light sensitive film during production or handling. During this test a roll of film is unwound at a high speed. If there is a large separation charge, due to the fact that two dissimilar materials are being separated, the electric field in the unwind nip will be large. It can be large enough such that the air can no longer sustain the intense field and air breakdown will occur resulting in a static discharge. Such discharge can potentially be harmful to a light sensitive emulsion which may be used for recording a sound track in an imbibition printing blank. Table 2 shows the results of such an unwinding electrification test which was performed on Samples 7, 8, 11 and 12.

TABLE 2

| Sample | Glow observed |
|---|---|
| 11 | yes |
| 7 | yes |
| 8 | yes |
| 12 | no |

Retransfer of dye from the printed front side of a dye imbibition print to the backside during storage in the roll can be a problem especially at high humidity and temperature. An antistatic backing layer can play an important part in this retransfer. To check for dye retransfer, the front sides of imbibition prints dyed with magenta dye M-1 were placed in contact with the backsides of each of Samples 1–12 and the Control Sample between two glass plates, and the assemblage was then placed in a chamber at 80 percent relative humidity and 38° C. for four days. The backs of the undyed imbibition prints were then observed for the presence of transfered dye. The results are shown in Table 3.

TABLE 3

| Example number | Dye present |
|---|---|
| 1 | no |
| 2 | no |
| 3 | no |
| 4 | no |
| 5 | no |
| 6 | no |
| 7 | yes |
| 8 | no |
| 9 | no |
| 10 | no |
| 11 | no |
| 12 | no |
| control | no |

Antistatic backings that contain a cationic polymeric material as in Sample 7 can result in dye retransfer as indicated above. Overcoating this antistat layer with a polymer as in Sample 8 may solve this retransfer problem, but poorer antistatic properties result.

In accordance with the most preferred embodiments of the invention, Samples 3, 5, 9, 10, and 12 meet the desired attributes of desired resistivity, no glow discharge and no dye retransfer. These examples all contain metal oxide antistats.

The invention has been described in detail with particular reference to preferred embodiments thereof, but it will be understood that variations and modifications can be effected within the spirit and scope of the invention.

What is claimed is:

1. In a motion picture film dye imbibition printing blank comprising a transparent polymeric film support bearing on one side thereof a dye-receiving layer comprising a cationic mordant, the improvement wherein the printing blank further comprises an antistatic layer substantially free of cationic polymers on the opposite side of the support relative to the dye-receiving layer.

2. A motion picture film dye imbibition printing blank according to claim 1, wherein the dye-receiving layer contains an imagewise-transferred anionic dye image, and the printing blank is rolled such that the dye-receiving layer side of the printing blank is in contact with the antistatic layer side of the printing blank.

3. A printing blank according to claim 1 wherein the antistatic layer comprises an anionic polymer, electronic conducting non-ionic polymer, metal halide or metal oxide.

4. A printing blank according to claim 1 wherein the antistatic layer comprises a metal halide or metal oxide and a polymer binder.

5. A printing blank according to claim 1 wherein the antistatic layer comprises a metal oxide and a polymer binder.

6. A motion picture film dye imbibition printing blank according to claim 1, further comprising a silver halide emulsion layer for recording a sound track.

7. A printing blank according to claim 6, further comprising a protective polymeric overcoat layer on the antistatic layer.

8. A printing blank according to claim 5 wherein the metal oxide is antimony doped tin oxide, aluminum doped zinc oxide, or niobium doped titanium oxide.

9. A printing blank according to claim 5 wherein the metal oxide is antimony-doped tin oxide or vanadium pentoxide.

10. A printing blank according to claim 1 wherein the antistatic layer comprises electrically-conductive metal-containing particles.

11. A printing blank according to claim 10 wherein the particles comprise donor-doped metal oxides, metal oxides containing oxygen deficiencies, nitrates, carbides or borides.

12. A printing blank according to claim 11 wherein the particles comprise conductive $TiO_2$, $SnO_2$, $Al_2O_3$, $ZrO_2$, $In_2O_3$, ZnO, $TiB_2$, $ZrB_2$, $NbB_3$, $CrB_2$, MoB, Wb, $LaB_6$, ZrN, TiN, TiC, WC, HfN, or ZrC.

13. A printing blank according to claim 1, wherein the cationic mordant is a quaternary ammonium or phosphonium mordant.

14. A printing blank according to claim 13, wherein the cationic mordant is of the formula:

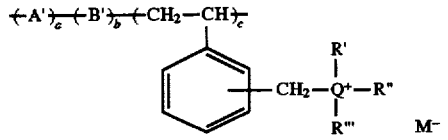

wherein A' represents units of an addition polymerizable monomer containing at least two ethylenically unsaturated groups; B' represents units of a copolymerizable α,β-ethylenically unsaturated monomer; Q is N or P; R', R", and R'" are independently carbocyclic or alkyl groups; $M^-$ is an anion; a is from about 0.25 to 10 mole percent; b is from about 0 to 90 mole percent; and c is from about 10 to 99 mole percent.

15. A printing blank according to claim 14, wherein a is from about 1 to 10 mole percent; b is from about 0 to 60 mole percent; and c is from about 40 to 99 mole percent.

16. A dye imbibition printing blank comprising a support bearing on one side thereof a dye-receiving layer comprising a cationic mordant, a silver halide emulsion layer for recording a sound track, and an antistatic layer substantially free of cationic polymers.

17. A printing blank according to claim 16, wherein the antistatic layer is provided on the opposite side of the support relative to the dye-receiving layer.

18. A printing blank according to claim 17 wherein the antistatic layer comprises an anionic polymer, electronic conducting non-ionic polymer, metal halide or metal oxide.

19. A printing blank according to claim 17 wherein the antistatic layer comprises electrically-conductive metal-containing particles.

20. A printing blank according to claim 17, wherein the dye-receiving layer contains an imagewise-transferred anionic dye image, and the printing blank is rolled such that the dye-receiving layer side of the printing blank is in contact with the antistatic layer side of the printing blank.

* * * * *

UNITED STATES PATENT AND TRADEMARK OFFICE

CERTIFICATE OF CORRECTION

PATENT NO. : 5,709,971

DATED : Jan. 20, 1998

INVENTOR(S) : Wayne Arthur Bowman, et al

It is certified that error appears in the above-identified patent and that said Letters Patent is hereby corrected as shown below:

Title page, column 1

Related U.S. Application Data

[60] Provisional application No. 60/000,367 Jun. 20, 1995.

Signed and Sealed this

Twenty-sixth Day of May, 1998

Bruce Lehman

*Attest:*

BRUCE LEHMAN

*Attesting Officer*

*Commissioner of Patents and Trademarks*